US011313074B2

(12) United States Patent
Prasad et al.

(10) Patent No.: US 11,313,074 B2
(45) Date of Patent: Apr. 26, 2022

(54) PROCESS FOR THE PREPARATION OF FUNCTIONALIZED WEATHER-RESISTANT AND SLOW-DECAYING GEOTEXTILES

(71) Applicants: Council of Scientific & Industrial Research, New Delhi (IN); Coir Board, Kochi (IN)

(72) Inventors: Vadakkethonippurathu Sivankuttynair Prasad, Thiruvananthapuram (IN); Padinjareveetil Anju, Thiruvananthapuram (IN); Methalayil Brahmakumar, Thiruvananthapuram (IN); Anitha Das Ravindranath, Kalavoor (IN); Sebastian Sumy, Kalavoor (IN)

(73) Assignee: Council of Scientific & Industrial Research, New Delhi (IN)

( * ) Notice: Subject to any disclaimer, the term of this patent is extended or adjusted under 35 U.S.C. 154(b) by 0 days.

(21) Appl. No.: 16/999,551

(22) Filed: Aug. 21, 2020

(65) Prior Publication Data

US 2021/0054564 A1 Feb. 25, 2021

(30) Foreign Application Priority Data

Aug. 22, 2019 (IN) ..... 201911033776

(51) Int. Cl.

| | |
|---|---|
| ***D06M 13/51*** | (2006.01) |
| ***B05D 3/02*** | (2006.01) |
| ***D06M 13/513*** | (2006.01) |
| ***B05D 3/06*** | (2006.01) |
| ***D06M 13/152*** | (2006.01) |
| ***D06M 13/207*** | (2006.01) |
| *B05D 1/02* | (2006.01) |
| *B05D 1/28* | (2006.01) |
| *D06M 101/04* | (2006.01) |

(52) U.S. Cl.

CPC ..... *D06M 13/513* (2013.01); *B05D 3/0254* (2013.01); *B05D 3/067* (2013.01); *D06M 13/152* (2013.01); *D06M 13/207* (2013.01); *B05D 1/02* (2013.01); *B05D 1/28* (2013.01); *D06M 2101/04* (2013.01); *D06M 2200/25* (2013.01); *D10B 2505/204* (2013.01)

(58) Field of Classification Search

CPC ..... D06M 13/513; B05D 3/0254

See application file for complete search history.

(56) References Cited

U.S. PATENT DOCUMENTS

| | | | |
|---|---|---|---|
| 5,678,954 | A | 10/1997 | Bestmann |
| 2018/0320332 | A1 | 11/2018 | Booth et al. |
| 2019/0075738 | A1 | 3/2019 | Manning et al. |

FOREIGN PATENT DOCUMENTS

| | | | |
|---|---|---|---|
| CN | 105926164 | A | 9/2016 |
| CN | 106381610 | A | 2/2017 |
| CN | 206090464 | U | 4/2017 |
| CN | 206884344 | U | 1/2018 |
| CN | 108559171 | A | 9/2018 |
| EP | 3147412 | A1 | 3/2017 |
| FR | 2879224 | A1 | 6/2006 |
| GB | 2482532 | A | 2/2012 |
| WO | 2004097104 | A2 | 11/2004 |
| WO | 2016132058 | A2 | 8/2016 |

OTHER PUBLICATIONS

Sumi et al. Surface Modification of Coir Fibers for Extended Hydrophobicity and Antimicrobial Property for Possible Geotextile Application. Journal of Natural Fibers vol. 14, Oct. 2016—Issue 3 (Year: 2016).*

Xie et al. Silane coupling agents used for natural fiber/polymer composites: A review. Composites Part A: Applied Science and Manufacturing vol. 41, Issue 7, Jul. 2010, pp. 806-819 (Year: 2010).*

Girish, et al., "Improvement of Durability of Coir Geotextiles", The Millennium Conference, pp. 309-310, 2000.

Prasad, et al., "Paper and PUlp Board from Coconut Leaves", Research and Industry, vol. 31, pp. 93-96, Jun. 1986.

Brigida, et al., "Effect of chemical treatments on properties of green coconut fiber", Carbohydrate Polymers, vol. 79, pp. 832-838, 2010.

Gowthaman, et al., "A State-of-the-Art Review on Soil Reinforcement Technology Using Natural Plant Fiber Materials: Past-Findings, Present Trends and Future Directions", Materials, vol. 11, pp. 1-23, 2018.

Subaida, et al., "Laboratory performance of unpaved roads reinforced with woven coir geotextiles", Geotextiles and Geomembranes, vol. 27, pp. 204-210, 2009.

Marques, et al., "Effects of the climatic conditions of the south-eastern Brazil on degradation the fibers of coir-geotextiles: Evaluation of mechanical and structural properties", Geotextiles and Geomembranes, vol. 30, pp. 1-7, 2013.

Sumi, et al., "Experiemental Investigations on Biological Resistance of Surface Modified Coir Geotextiles", International Journal of Geosynth and Ground Eng., pp. 1-9, 2016.

Sumi S., et al., "Effects of Antimicrobial Agents on Modification of Coir", ScienceDirect, Procedia Technology, vol. 24, pp. 280-286, 2016.

Saha, et al., "Durability of transesterified jute geotextiles", Geotextiles and Geomembranes, vol. 35, pp. 69-75, 2012.

(Continued)

*Primary Examiner* — Cachet I Proctor

(74) *Attorney, Agent, or Firm* — Dinsmore & Shohl, LLP

(57) ABSTRACT

Processes for making weather resistant, slow-decaying, durable natural fiber/coir geotextiles produce geotextiles having flexibility, permeability, light weight and cost-effective characteristics. In this process an in situ chemical grafting using a mixture of Cashew Nut Shell Liquid and aminoalkyl trialkoxysilanes with cellulose was done followed by curing in presence of sunlight, UV light or heat. The developed product showed durability and strength more than that of natural fiber/fabric and retaining natural fiber/fabric/geotextiles characteristics. The geotextiles have delayed bio-deterioration having wider long-term end use/applications. This process of making durable geotextiles is eco-friendly and retains the desired characteristic.

8 Claims, No Drawings

(56) References Cited

OTHER PUBLICATIONS

Subaida, et al., "Experimental investigations on tensile and pullout behaviour of woven coir geotextiles", Geotextiles and Geomembranes, vol. 26, pp. 384-392, 2008.
Lal, et al., "Effect of reinforcement form on the behaviour of coir geotextile-reinforced sand through laboratory triaxial compression tests", International Journal of Geotechnical Engineering, pp. 1-8, 2017.
Lekha, "Field instrumentation and monitoring of soil erosion in coir geotextile stabilised slopes—A case study", Geotextiles and Geomembranes, vol. 22, pp. 399-413, 2004.
Peter, et al., "Laboratory Investigation In The Improvement Of Subgrade Characteristics Of Expansive Soil Stabilised With Coir Waste", ScienceDirect, Transportation Research Procedia, vol. 17, pp. 558-566, 2016.
Sumi, et al., "Surface Modification of Coir Fibers for Extended Hydrophobicity and Antimicrobial Property for Possible Geotextile Application", Journal of Natural Fibers, pp. 1-12, 2016.
Sanyal, et al., "Application of Bitumen-Coated Jute Geotextile in Bank-Protection Works in the Hooghly Estuary", Geotextiles and Geomembranes, vol. 13, pp. 127-132, 1994.
Pattnaik, et al., "Application of Geotextiles in Pavement", International Journal of Engineering Sciences & Research Technology, vol. 11, pp. 244-251, Nov. 2016.
Ghosh, et al., "Suitability of Natural Fibres in Geotextile Applications", IGC Geotide, pp. 497-501, 2009.

* cited by examiner

PROCESS FOR THE PREPARATION OF FUNCTIONALIZED WEATHER-RESISTANT AND SLOW-DECAYING GEOTEXTILES

CROSS REFERENCES TO RELATED APPLICATIONS

This application claims the benefit of priority under 35 U.S.C. § 119(a)-(d) to Indian Patent Application No. 201911033776, filed Aug. 22, 2019, which application is hereby incorporated by reference herein.

TECHNICAL FIELD

The present disclosure relates to a process for making weather-resistant and slow-decaying geotextiles using natural plant fibers. In particular, the present disclosure relates to coir and their products to make weather-resistant and slow decaying geotextiles, with enhanced longevity properties, which would be durable, having a desired long and effective life span while retaining their flexibility, eco-friendliness, permeability, light weight and cost-effectiveness.

BACKGROUND

Geotextiles are permeable fabrics which when used in association with soil, have the ability to separate, filter, reinforce, protect, or drain. Synthetic geotextiles, typically made from polypropylene or polyester, come in three basic forms: woven, non-woven or mat or felt type. Geotextile composites have also been introduced as geogrids and meshes. These materials are referred to as geosynthetics and each configuration, geonets, geosynthetic clay liners, geogrids, geotextile tubes, and others can yield benefits in geotechnical and environmental engineering design, in the prevention of soil erosion, road construction of marshy lands, mulching, gardening and protection of river banks.

Geotextiles were intended to be an alternative to granular soil filters. Use of geotextiles began in 1950s behind precast concrete seawalls, under precast concrete erosion control blocks, beneath large stone, and in other erosion control situations (Triptimalapattnaik et al., IJESRT, 2016, 5, 850-860). Geotextiles and related products have many civil engineering applications including roads, airfields, rail roads, embankments, retaining structures, reservoirs, canals, dams, bank protection, coastal engineering, and silt fences in construction sites.

The use of geosynthetic products as inclusion in flexible pavements for reinforcement has been demonstrated to be a viable technology through studies conducted over the last three decades which results in increased service life of the pavement or reduced base thickness to carry the same number of load repetitions. However, the drawbacks of these reports include the nondegradability of the geosynthetics causing extreme environmental pollution leading to irrecoverable damage to ecosystem.

High cost of geosynthetics and stringent environmental protection requirements make it important to explore alternative natural products to make the constructions cost efficient and eco-friendly. Since commodity plastics used in geosynthetics are non-ecofriendly, cellulosic natural fibers are considered as best alternative. The use of natural fibers such as jute and coir fiber in geotextile applications for erosion control, slope stabilization and bioengineering is wide spread, due to the substantial mechanical properties of these fibers especially that of coir. (Banerjee et al., 1997, Proc. Geosyn, Asia '97, 1997; Brigida et al. Carbohydr. Polym., 2010, 79, 832-838; Girish et al., Proc. Indian Geotextiles Conference, 2000; Gowthaman et al. Materials, 2018, 11, 553).

Coir, which is the husk of coconut, the seed of *Cocos nucifera* cultivated in South-Indian coastal areas, Srilanka, Brazil, Caribbean islands, Vietnam etc., is a common waste material where coconuts are grown and subsequently processed. The coir geotextiles give protective and attractive covering of a vegetated embankment. Coir has the highest tensile strength of any natural fiber due to its high lignin content and retains much of its tensile strength when wet. It is also very long lasting, with infield service life of 4 to 10 years. It is reported that results of testing on jute, sisal, coir and cotton over a prolonged period of time in highly fertile soil maintained at high humidity (90%) and moderate temperature, coir retained 20% of its strength after one year, whereas cotton degraded in six weeks and jute degraded in eight weeks. Coir geotextile (MMA3 and MMV2) is capable to prevent surface erosion of particles along the surface of a slope and facilitates in sedimentation of soil on previously exposed rock surfaces. Even after six months, the matting retained 56% of its original strength. Coir geotextiles last approximately 3 to 5 years depending on the fabric weight, which ultimately degrades into humus, enriching the soil. The strength of coir geotextile comes down by 50% by 6 months of use.

Natural fibers such as sisal, palm, bagasse, flax, hemp, jute and coir have been used for manufacturing geotextiles because they are inexpensive, renewable agricultural commodities unlike their man-made petroleum-based alternatives. Geotextiles based on jute fibers lead to swelling and water absorption, reduction in soil run off energy and improvement in filtration characteristics of the fabric to providing stability in an erosion control application. They also prevent extreme variations in soil moisture and temperature. In unpaved roads temporary use of these geotextiles, where the rate of plastic deformation of soft subgrade soil due to repeated traffic loads is faster during the initial stage and gets stabilized later, by consolidation of the soft subgrade soil which will make reinforcement unnecessary in the long-term. Natural fiber geotextiles can be a feasible solution in such applications where these products are meant to serve only during the initial stage and final strength is attained by soil consolidation due to passage of vehicles.

Placement of geotextile at the interface of the subgrade and base course increased the load carrying capacity significantly at large deformations. Significant improvement in bearing capacity was noticed when coir geotextile was placed within the base course at all levels of deformations, where the optimum results were obtained at a depth of one-third of the plate diameter below the surface. The plastic surface deformation under repeated loading will substantially get reduced by the inclusion of coir geotextiles within the base course irrespective of the thickness. Closely woven coir geotextiles possess high tensile strength and pull out resistance, which can be economically utilized for temporary reinforcement purposes (Subaida et al. Geotextiles and 2009, 27(3):204-210). Coir geotextiles are also used to support vegetation growth, which, in turn, imparts mechanical resistance of soils against erosion and sliding. Biodegradable coir geotextiles combined with native seeds can be used to restore degraded forest areas in tropical countries where rainfall rates are high.

Reference may be made to Marquez, 2013, (Marques, A. R., et al., Effects of the climatic conditions of the southeastern Brazil on degradation the fibers of coir-geotextile: Evaluation of mechanical and structural properties, Geotextiles and Geomembranes (2013), http://dx.doi.org/10.1016/j.geotexmem.2013.07.004) which relates to the treatment of geotextiles with lime for improvement of the longevity in actual field conditions in tropical area. The results showed that after 12 months of exposure, untreated fiber had retained 23% but lime treated fiber 19% of their initial strength though it showed a higher retention of strength up to 3 months especially in acidic soils.

Reference may be made to the work by Pillai et al. [Pillai, C. K. S., M. A. Venkataswamy, K. G. Satyanarayana, and P. K. Rohatgi. 1983. Preserving coconut leaf thatch: A simple method. Indian Coconut Journal 14:3-6.] which reports the life extension of coconut leaf thatch for 5 years using cashew nut shell liquid (CNSL) and $CuSO_4$ treatment. Similar treatment of coir geotextile for microbial resistance was reported by Sumi et al., 2012 [Sumi, S., Unnikrishnan, N., Mathew, L. Experimental Investigations on Biological Resistance of Surface Modified Coir Geotextiles Int. J. of Geosynth. and Ground Eng. 2016, 2, 31] which shows that treated fibers inhibit the development of fungal growth on fiber surface by 95%. The biological resistance of coir geotextiles was greatly improved by modification with CNSL. The tensile strength of unmodified samples reduced to 19% whereas modified geotextiles retained 76% of the initial tensile strength at the end of 6 months of soil burial. SEM images confirmed that modification of coir with CNSL could close the pores on fiber surface and delaying biological degradation. However, the drawbacks of these reports include the absence of data on the effect of treatment on natural weathering.

Reference may be made to Sumi et al. 2016, [Sumi, S, Unnikrishnan N, Mathew, L. Effect of Antimicrobial Agents on Modification of Coir, Procedia Technology 24 (2016) 280-286] wherein the microbial degradation study was performed with coir coated with natural antimicrobial agents such as CNSL, neem oil and tulsi oil for improving its hydrophobicity, tensile strength and biological resistance. The results indicated that coating of coir yarns with CNSL was capable of increasing tensile strength by 17% and reducing moisture absorption by 34%. Microbial activity of CNSL coated coir yarns was reduced to 95%. Jute (*Corchorus olitorius*) fabric was treated with an emulsion of mixture containing CNSL, NaOH, plant tannin, resorcinol, neem oil and formaldehyde in 1:10:8:2:6:4 for 24 hours as antimicrobial coating (Saha, P., Roy, D., Manna, S., Adhikari, B., Sen, R., Roy, S. Durability of transesterified jute geotextiles. Geotextiles and Geomembranes, 35 (2012) 69-75]. The process lead to partial transesterification of some of the hydroxyl groups present within jute fibers. The treated fabrics were less hydrophilic and more resistant to degradation. The treatment did not adversely affect flexibility, tensile strength and filtration characteristics of the fabrics. The observed, 50% loss in tensile strength after immersing in solutions within 120 days. It was estimated that geotextiles manufactured from this treated jute fiber would lose 50% of their initial tensile strength in about 3 years, due to UV and moisture related weathering and biodegradation in a tropical field installation environment. These half-lives are about 3-5 times longer than those reported for untreated jute geotextiles. However, the drawbacks of these reports include absence of data on field trials or standard test results on weathering under natural conditions.

Several attempts have been made to enhance the resistance of jute geotextiles against biological degradation by coating them with bitumen (Sanyal and Chakraborty, 1994) [Sanyal, T. Applications of bitumen coated jute geotextile in river bank protection works in the hoogley estuary, Geotextiles and Geomembranes, 1994, 13, 67-89] or antimicrobial benzothiazole chemicals (Sinha and Chakraborty, 2004) [Sinha, S., Chakraborty, S., A rot resistant durable natural fiber and/or geotextiles. Patent Application Number: PCT/IN2004000119, 2004]. However, these techniques are expensive and turn the coated fabric into a potential source of toxic leachates. In addition, bitumen treatment adversely affects the flexibility and drapability of geotextiles. Geotextiles have also been manufactured from jute fibers blended with synthetic fibers for durability enhancement, but lead to disintegration of fabric structure. However, the drawbacks of these reports include the disintegration of the fabric and toxicity of the leachate.

Reference may be made to CN105926164, which reports jute and carbon fiber geotextiles with good anti-ageing property, high temperature resistance, having high tensile strength and good permeability. IN514/KOL/2007 reports jute-polyolefin blended woven geotextiles for road construction. Ecological coir roll element for use in protecting shoreline to prevent erosion has been reported in U.S. Pat. No. 5,678,954. Anti-ageing geotextile preparation method for polypropylene by treatment with modified montmorillonite and antioxidants was reported in CN108559171. CN206090464 discloses the design of air bag on one side of the geotextile to increase the life by reducing the impact, in case the geotextiles are used in riverbanks. Polyethylene based geotextile with anti-corrosive coating was reported in CN206884344. High strength weatherproof type geotextiles of plastic materials is also documented in CN106381610. However, the drawbacks of these reports include nondegradability of the material and ecotoxicity.

Improved methods to manufacture jute geotextile using spray coated polydimethyl siloxane (PDMS) have been reported in GB2482532. Rot resistant and durable natural fiber/geotextile manufacture using benzothiazol as coating agent for jute is reported in IN2004000119. Seamless geotextile with cellular structure for soil stabilization is reported in IN 201717034735, and EP3147412. Woven Geotextile Fabrics with higher water flow rate is reported in US2018320332. A geotextile-based structure for soil stabilization, erosion control, and vegetation-growth enhancement that is made from a cage having a hollow interior lined with a geotextile fabric designed to retain fine materials, capable of supporting vegetation is reported in US 201762558205P. Process for treating vegetable fibers intended for making biodegradable geotextile, useful in textile industry comprising coating the fiber with a product layer of a waterproofing agent is reported in FR2879224. Geotextile for reinforcement, for fighting erosion and for assisting with revegetation based on natural fibers such as coir, jute or synthetic fibers with oxo-biodegradable polymers such as PLA is reported in WO2016132058A2. However, the drawbacks of these reports include absence of weather resistance data.

From the hitherto reported literature, it may be noted that none of reported prior arts have incorporated surface coating with phenolic plant exudates such as cashew nut shell or similar pentadecenyl phenol derivatives to modify coir geotextiles.

Accordingly, there exists a dire need to prepare durable, cost-effective, and environment-friendly geotextiles that could be employed in improving the soil texture, constructing dams, pools, roads, embankments, pipelines and the like, wherein the process of preparation should majorly focus on employing combinatorial modifications of coir in order to increase the longevity thereof by way of impregnating coir with a mixture of CNSL (Cashew Nut Shell Liquid) along with AS (Amino propyl triethoxysilane).

SUMMARY

Embodiments of this disclosure provide processes for making weather-resistant and slow-decaying geotextiles with enhanced longevity properties and flexibility. In embodiments, combinatorial modifications of coir are made in order to increase the longevity thereof by way of impregnating coir with a mixture of CNSL (Cashew Nut Shell Liquid) along with AS (Amino propyl triethoxysilane) in the ratio 3:1.

In an embodiment, a process for the preparation of functionalized weather-resistant and slow-decaying geotextile comprises: (a) mixing 3-pentadecenyl phenol with aminoalkyl trialkoxysilane in the ratio of 3:1 to 1:1 (v/v) at a temperature in the range of 30° C.±5° C. and humidity of 60% to 70%; (b) impregnating the mixture as obtained in (a) on a coir fibers; and (c) curing the impregnated coir fibers as obtained in (b) under heat or UV or air or sunlight at a temperature ranging from 80° C. to 90° C. to obtain the functionalized weather-resistant and slow-decaying geotextile.

In another embodiment, the 3-pentadecenyl phenols are selected from the group consisting of cashew nut shell liquid, urushiol, cardanol, cardol, and anacardic acid.

In another embodiment, the aminoalkyl trialkoxysilanes are selected from the group consisting of aminopropyl triethoxysilane and 2-aminoethyl triethoxysilane.

In another embodiment, silanols are the intermediates used in condensation with primary alcohol groups of cellulose chain.

In another embodiment, the coating is cured by keeping in ambient conditions at a temperature in the range of 30° C.±5° C. and at a humidity of 60% to 70% for 3 to 7 days.

In another embodiment, the coating is cured by keeping in sunlight for a period of 6 hours to 12 hours, or UV-light for a period of 3 hours to 5 hours and air oven at a temperature ranging from 60° C. to 90° C. for a period of 5 hours to 8 hours.

In another embodiment, the impregnated coir is kept at a temperature ranging from 30° C.±5° C. for a period of 7 to 10 days.

In an embodiment, the coir fibers of *Cocos nucifera* in woven or non-woven form are used for making geotextiles.

In another embodiment, the geotextile, made from jute fibers of *Corchorus capsularis* and *Corchorus olitorius* are used for soil erosion control or embankment.

In still another embodiment, the surface coating is prepared using phenolic plant exudates such as cashew nut shell or similar pentadecenyl phenol derivatives.

In yet another embodiment, the silylation of the phenolic compounds is done at room temperature followed by condensation with alkoxy amino silyl derivatives, including amino propyl triethoxysilane.

In still another embodiment, the in situ grafting of pentadecenyl phenoxy moiety on to cellulose and polymerization is done at a temperature in the range of 30° C.±5° C. at a humidity of 60% to 65%.

In another embodiment, the geotextiles made from jute fibers of *Corchorus capsularis* and *Corchorus olitorius* are used for soil erosion control or embankment.

In another embodiment, cross linking is done under natural sun light.

In yet another embodiment, UV-light is used for curing the coating in presence or absence of photo cross-linkers such as benzophenone derivatives.

In still another embodiment, the coating is cured by keeping it in ultraviolet light for 20 minutes to 60 minutes.

In yet another embodiment, 3-pentadecenyl phenols and aminoalkyl trimethoxysilanes are mixed at 3:1 to 1:1 ratio v/v and kept at a temperature of 30° C.±5° C. at a humidity of 60% to 65% for 7 to 10 days, and further coated on the geotextile fabric and dried in presence of 2% to 5% of excess 3-aminopropyl trimethoxysilane for a period of 0.5 h to 1.0 h under UV light.

In still another embodiment, the standard Xenon arc test showed increased tensile strength with time compared to untreated samples up to 15 hours.

In a further embodiment, no decrease in tensile strength was observed under durability studies as per ASTM 5819 up to 6 months compared to the control, which showed complete degradation. As per ASTM D4355 Xenon Arc Test for accelerated weathering, breaking force increased from 9.74 kN/m to 11.81 kN/m after 15 hours, compared to a decrease from 17.14 kN/m to 15.28 kN/m in the case of the control sample.

The main objective is therefore to provide weather-resistant and slow-decaying geotextiles.

Another objective is to provide a process for the preparation of weather-resistant and slow-decaying geotextiles that increases the durability or longevity of the coir geotextiles by their surface treatment; thereby delaying the degradation due to hydrolysis or termite attack or by moisture induced environmental stress.

Still another objective is to treat geotextiles with water resistant phenolic coatings to reduce the hydrolytic degradation.

Yet another objective is grafting or selective binding of the water repellents by functionalization to enhance the efficiency of the coating.

Still another objective is to create functionalized geotextiles by creating controlled/optimized pentadecenylphenoxy or similar groups on the surface by aminosilyl functionalization to stabilize the system against degradation under sun light.

Yet another objective is to provide a process for in-situ polymerization and cross-linking of the grafted long chain vinyl moieties to obtain efficient surface coating preventing water absorption and subsequent degradation enhancing the longevity and weather resistance.

Still another objective is to provide a process for controlled cross-linking/curing by UV in the presence or absence of derivatives of benzophenone and photo cross-linkers.

DETAILS OF THE BIOLOGICAL RESOURCES USED

This disclosure utilizes CNSL, which is a byproduct of Cashew Nut processing industry. CNSL as referenced in this disclosure was obtained from Vijayalaxmi Cashew Company, Kochupilamood, Kollam, Kerala 691001, India. (Contact: 91-474-274-1391; 91-474-2754-200; Mob: 91-8921182048, e-mail: vlccashews@gmail.com).

Coir Geotextile was procured from Coirfed-Kerala State Co-Operative Coir Marketing Federation Ltd., Post Box No. 4616, Ravi Karunakaran Road, Alappuzha, Kerala-688012, India.

DETAILED DESCRIPTION

Embodiments of this disclosure explain, along with the representative experiments described herein below a process for the extension of lifetime of geotextiles prepared from coir and such cellulosic natural fibers by chemical grafting and curing for utilization as weather resistant and slow-decaying geotextiles. In situ surface modification or reactive coating of cellulosic hydroxyl groups by silyloxy pentadecenyl phenol derivatives formed by the reaction of CNSL with aminopropyl triethoxysilane and further curing in presence of sunlight, heat, or UV light optionally in presence of photo cross-linkers are explained as embodiment of the finding.

The coir geotextile woven mats of GSM900 or GSM1200 were soaked with a solution of aminosilane derivatives and impregnated in situ with CNSL and then cured under ambient conditions by air drying, drying under sunlight by spreading. The curing was accelerated in the presence of UV light or in the presence of heat. CNSL and 3-aminopropyl trimethoxysilane were mixed at 3:1 ratio v/v and kept at a temperature of 30° C.±2° C. and a humidity of 60% to 65% for 7 to 10 days. Further, the mixture was coated on the geotextile fabric in presence of 2% to 5% 3-aminopropyl trimethoxysilane, which showed enhanced curing.

These Geotextile samples showed retention or increase in tensile properties under standard Xenon arc test (D4355) compared to uncoated geotextile samples exhibiting weather-resistance. The standard degradation studies as per ASTM D5970, showed slow-decay than that of untreated geotextiles.

Thus, the present disclosure provides geotextiles having improved longevity. Further, the geotextiles according to embodiments have lower water absorption. Also, the geotextiles exhibit less erosion or no erosion in strength under a standard Xenon arc test compared to untreated samples. Further, the geotextiles are weather resistant and termite resistant.

EXAMPLES

The following examples are given by way of illustration only and therefore should not be construed to limit the scope of the present disclosure or the appended claims in any manner.

Example 1

Cashew nut shell liquid (CNSL) was mixed with aminopropyl triethoxysilane (AS), in 3:1 volume ratio, impregnated on the woven coir geotextile [GT] mat of GSM740 roll, H2M5 Vycome (GT) using a two roll mill, and further cured by keeping under ambient conditions for 5 to 7 days.

Example 2

Cardanol was mixed with AS, in 3:1 volume ratio, diluted to 30%, impregnated on the GT roll using a two-roll mill, and further dried by spreading under sunlight for 5 to 6 hours.

Example 3

CNSL was mixed with AS, in 3:1 volume ratio, kept for 7 to 10 days under ambient conditions at sealed conditions from moisture and air, diluted with hexane to 30% solution, impregnated on the GT roll using a two roll mill, and further kept under UV light of 275 nm for 30 to 60 minutes.

Example 4

CNSL was mixed with 2-aminoethyl triethoxysilane, in 3:1 volume ratio, kept for 7 to 10 days under ambient conditions at closed conditions, diluted with hexane to 30% solution, impregnated on the GT roll using a two roll mill, and further kept under sunlight for 2 to 4 hours.

Example 5

GT was spray coated with 50% by volume of AS solution in acetone and was simultaneously reacted in situ in the presence of CNSL solution in acetone (20%-50% by weight), simultaneously impregnated using a two-roll mill, by simultaneous dozing of the 50% AS solution in acetone to the roller through a homogeneous sprinkler, and further cured by keeping under ambient conditions for 5 to 7 days.

Example 6

GT was spray coated with 50% by volume of AS solution in acetone in the presence of CNSL solution in acetone (20% to 50% by weight), simultaneously dip coated using a two-roll mill, by simultaneous dozing of the 50% AS solution and benzophenone solution (0.5% to 2.0% by weight) in acetone to the roller through homogeneous sprinklers, and kept under UV light at 275 nm to 365 nm for 5 to 10 minutes.

TABLE 1

Data on weathering studies of Geotextile (GT) as per ASTM D5970/16

| S. no. | Control | Modifications via chemical treatments | Impact on longevity (Strength retained in outdoor exposure for 6 months as measured by ASTM D5970) |
|---|---|---|---|
| 1. | GT roll | GT roll + (Cardanol + AS, 3:1) | 98% |
| 2. | GT roll | GT roll + (Cardanol + AS, 1:1) | 98% |
| 3. | GT roll | GT roll + (Cardanol + AS, 3:1) + 30% dilution + dried (5-6 hours) | 98% |
| 4. | GT roll | GT roll + (Cardanol + AS, 1:1) + 30% dilution + dried (5-6 hours) | 98% |
| 5. | GT roll | GT roll + (CNSL + AS, 3:1) + 30% $C_6H_{14}$ + UV (275 nm, 30-60 min.) | 100% |
| 6. | GT roll | GT roll + (CNSL + AS, 1:1) + 30% $C_6H_{14}$ + UV (275 nm, 30-60 min.) | 100% |
| 7. | GT roll | GT roll + (CNSL + AS, 3:1) 7-8 days + dilution 30% $C_6H_{14}$ | 105% |
| 8. | GT roll | GT roll + (CNSL + AS, 1:1) 7-8 days + dilution 30% $C_6H_{14}$ | 105% |

TABLE 1-continued

Data on weathering studies of Geotextile (GT) as per ASTM D5970/16

| S. no. | Control | Modifications via chemical treatments | Impact on longevity (Strength retained in outdoor exposure for 6 months as measured by ASTM D5970) |
|---|---|---|---|
| 9. | GT roll | GT roll + AS in Acetone 50% (v) + CNSL in Acetone 20-50% (w) + curing 5-7 days | 105% |
| 10. | GT roll | GT roll + AS solution in Acetone(v) + CNSL in acetone 20-50% (w) in Acetone | 102% |
| 11. | Control | Nil | 55% |
| 12. | GT Roll | GT Roll + CNSL in Acetone 20-50% + dried in sunlight for 5-7 days | 80% |

We claim:

1. A process for preparing a functionalized weather-resistant and slow-decaying geotextile fabric formed of coir fibers, the process comprising:

(a) mixing 3-pentadecenyl phenols with aminoalkyl trialkoxysilanes in a ratio of from 1:1 to 3:1 (v/v) at a temperature of 30° C.±5° C. and humidity of 60% to 70% to obtain a mixture;

(b) impregnating or coating the coir fibers of the geotextile fabric with the mixture as obtained in (a); and (c) curing the impregnated or coated coir fibers obtained in (b) under heat, UV, air, or sunlight to obtain the functionalized weather-resistant and slow-decaying geotextile fabric.

2. The process of claim 1, wherein the coir fibers are from *Cocos nucifera* and are in woven or non-woven form.

3. The process of claim 1, wherein the 3-pentadecenyl phenols are selected from the group consisting of cashew nut shell liquid, urushiol, cardanol, cardol, and anacardic acid.

4. The process of claim 1, wherein the aminoalkyl trialkoxysilanes are selected from the group consisting of aminopropyl triethoxysilane and 2-aminoethyl triethoxysilane.

5. The process of claim 1, wherein curing the impregnated or coated coir fibers comprises keeping the coir fibers at a temperature of 30° C.±5° C. and at a humidity of 60% to 70% for 3 days to 7 days.

6. The process of claim 1, wherein curing the impregnated or coated coir fibers comprises keeping the coir fibers in sunlight for a period of 6 hours to 12 hours, or in UV-light for a period of 3 hours to 5 hours, or in an air oven at a temperature from 60° C. to 90° C. for a period of 5 hours to 8 hours.

7. The process of claim 1, wherein curing the impregnated coir fibers comprises keeping the coir fibers at a temperature of 30° C.±5° C. for a period of 7 days to 10 days.

8. The process of claim 1, wherein (a) further comprises keeping the mixture at a temperature of 30° C.±5° C. at a humidity of 60% to 65% for 7 days to 10 days, and wherein (b) comprises coating the coir fibers of the geotextile fabric in the presence of 2% to 5% of excess 3-aminopropyl trimethoxysilane, and wherein (c) comprises curing the coated coir fibers for a period of 0.5 hours to 1.0 hours under UV light.

* * * * *